US007225796B2

(12) United States Patent
Reddy et al.

(10) Patent No.: US 7,225,796 B2
(45) Date of Patent: Jun. 5, 2007

(54) CONTROL OF INDUCTION SYSTEM HYDROCARBON EMISSIONS

(75) Inventors: Sam R. Reddy, West Bloomfield, MI (US); David H. Coleman, Highland, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/122,174

(22) Filed: May 4, 2005

(65) Prior Publication Data

US 2006/0249125 A1 Nov. 9, 2006

(51) Int. Cl.
*F02M 37/04* (2006.01)

(52) U.S. Cl. ..... 123/516; 123/467

(58) Field of Classification Search ..... 123/516, 123/467, 456, 518, 509, 179.17
See application file for complete search history.

(56) References Cited

U.S. PATENT DOCUMENTS 4,972,869 A * 11/1990 Takasaki ..... 137/199
5,074,272 A * 12/1991 Bostick et al. ..... 123/514
5,655,892 A * 8/1997 Cherniawski et al. ..... 417/292
5,823,169 A * 10/1998 Strohl et al. ..... 123/516
6,047,686 A * 4/2000 Bohringer et al. ..... 123/516
6,530,364 B1 * 3/2003 Romanek ..... 123/516

* cited by examiner

*Primary Examiner*—Carl S. Miller
(74) *Attorney, Agent, or Firm*—Kathryn A. Marra

(57) ABSTRACT

A method and apparatus for reducing or preventing hydrocarbon emissions from an air induction system of an automotive vehicle during diurnal periods opens the fuel line to ambient fuel tank pressure when fuel pressure in the fuel line decreases due to cooling of the fuel.

4 Claims, 2 Drawing Sheets

CONTROL OF INDUCTION SYSTEM HYDROCARBON EMISSIONS

FIELD OF THE INVENTION

The present invention relates generally to systems and methods for controlling hydrocarbon emissions in automotive vehicles.

BACKGROUND OF THE INVENTION

The automotive industry has actively sought improved emissions reduction, including reduction in emissions due to gasoline evaporation. Gasoline includes a mixture of hydrocarbons ranging from higher volatility butanes ($C_4$) to lower volatility $C_8$ to $C_{10}$ hydrocarbons. When vapor pressure increases in the fuel tank due to conditions such as higher ambient temperature or displacement of vapor during filling of the tank, fuel vapor may flow through openings in the fuel tank and escape into the atmosphere. To prevent fuel vapor loss into the atmosphere, the fuel tank is vented into a canister called an "evap canister" that contains an adsorbent material such as activated carbon granules. As the fuel vapor enters an inlet of the canister, the fuel vapor diffuses into the carbon granules and is temporarily adsorbed. The size of the canister and the volume of the adsorbent material are selected to accommodate the expected fuel vapor generation. One exemplary evaporative control system is described in U.S. Pat. No. 6,279,548 to Reddy, which is hereby incorporated by reference.

Evaporative emission control systems have advanced to the point where vehicle induction system or air intake system hydrocarbon emissions account for a significant portion of remaining hydrocarbon emissions. Intake system hydrocarbon emissions may arise from diffusion of a fuel leaked from fuel injectors after engine shut down. Hydrocarbon traps containing an adsorbent such as activated carbon may be added to the air intake to absorb such emissions, which may then be desorbed by engine intake air when the engine is operating, but would add cost and complexity to manufacture of the vehicle. A less costly but still effective way to eliminate or reduce the emissions would be desirable.

SUMMARY OF THE INVENTION

In an embodiment of the invention, a method for reducing or preventing hydrocarbon emissions from an air induction system after an engine is shut down by preventing increase in fuel pressure in the fuel rail during diurnal temperature increases. Fuel pressure in the fuel rail may cause fuel injector leakage, which is avoided when there is no pressure in the fuel line and fuel rail.

In a method of the invention, when the engine is shut down, the fuel pressure in the fuel line drops due to cooling, then the fuel line is opened to ambient fuel tank pressure. During engine operation, the fuel pump in the vehicle fuel tank maintains pressure in the fuel rail (e.g., about 400 kPa). A pressure relief valve keeps the pressure not higher than the desired maximum (e.g., 400 kPa) and a vacuum relief valve keeps vacuum below about 20 kPa. After engine shut down, the fuel in the rail is left under pressure to avoid fuel boiling, which can cause problems when the engine is re-started. As the fuel cools, the pressure decreases due to liquid fuel thermal contraction. In the method of the invention, the pressure is not allowed to build up again during the diurnal period by opening the fuel line to ambient fuel tank pressure fuel in the fuel line has cooled. A valve opens the fuel line to ambient fuel tank pressure when fuel pressure in the fuel line decreases to the ambient fuel tank pressure. The valve may also be actuated when fuel in the fuel line cools to a desired temperature or reaches a desired fuel pressure to open the fuel line to ambient fuel tank pressure.

In an embodiment of the invention, an automotive vehicle having a fuel tank containing fuel and a fuel pump that supplies fuel under pressure through a fuel line to engine fuel injectors extending into an air intake manifold of an air induction system, includes in the fuel pump a valve that, when the engine is not operating, opens after the fuel has cooled to reduce fuel pressure in the fuel line to ambient fuel tank pressure and remains open until next engine start. The pressure release valve prevents further pressure build up in the fuel line due to diurnal temperature increase that may cause fuel to leak from the fuel injectors into the air induction system and be emitted into the atmosphere.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figures 1A, 1B:
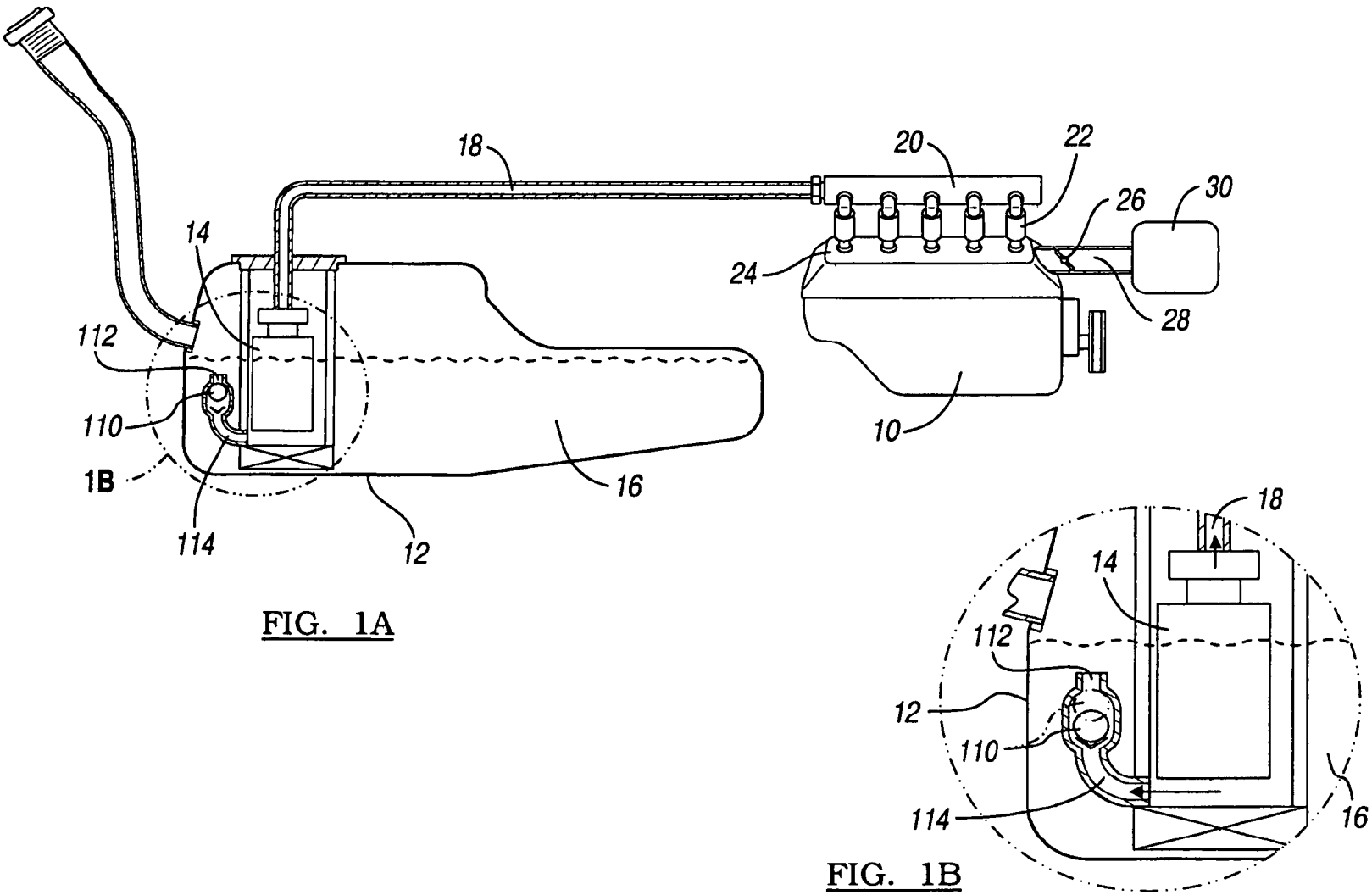
FIG. 1A is a functional block diagram of an engine and fuel injection system for a vehicle according to the invention showing detail in FIG. 1B and FIGS. 2A–2C graphically illustrate induction system hydrocarbon emissions (FIG. 2C) from the system of the invention (FIG. 2B) compared to a prior art system without a pressure release valve (FIG. 2A).

The following description of the preferred embodiment(s) is merely exemplary in nature and is in no way intended to limit the invention, its application, or uses.

Referring now to FIG. 1, an internal combustion engine 10 having an intake manifold 24 and fuel tank 12 is illustrated. The engine may be part of a conventional (non-hybrid) vehicle including only the internal combustion engine or part of a hybrid vehicle including the internal combustion engine and an electric motor (not shown). The engine 10 typically burns gasoline, ethanol, and other volatile hydrocarbon-based fuels. During engine operation, fuel 16 is delivered from the fuel tank 12 by a fuel pump 14 through fuel line 18 to a fuel rail 20. Fuel injectors 22 located along fuel rail 20 inject fuel into air intake manifold 24, from where the air/fuel mixture is drawn into cylinders of the engine 10 and combusted to provide power to the engine 10. Air intake into intake manifold 24 is controlled by a valve 26 in air induction system line 28, and intake air is drawn through air filter 30.

Fuel pumps such as pump 14 generally pump fuel through a filter into a pressure regulator, which supplies fuel to the fuel line only to the desired maximum pressure and returns excess fuel to the tank via a by-pass line. The fuel pump of the invention has a valve that opens the fuel line to ambient fuel tank pressure after engine shut-down when the cooling of the fuel in the fuel line has reduced the pressure to the ambient fuel pressure in the fuel tank. The valve remains open until the engine is once again started. The valve then closes so that the fuel line can once again be pressurized with the desired fuel pressure.

In one embodiment, illustrated in FIG. 1A and shown in more detail in FIG. 1B, the valve (not shown to scale) is a pop-open valve containing a ball 110 that seats against passage 112 or drops toward passage 114. Passage 112 leads into fuel tank 12; pressure against ball 110 from passage 112 is, therefore, the ambient pressure in fuel tank 12. Passage 114 connects to fuel line 18; pressure against ball 110 from passage 114 is, therefore, the pressure in fuel line 18. During engine operation, the fuel in fuel line 18 is pressurized relative to ambient fuel tank pressure. For example, a pressure of about 400 kPa may be maintained in the fuel line by fuel pump 14. Initially after the engine stops, the fuel line pressure will continue to contain the fuel at an initial temperature and to be pressurized relative to the ambient fuel tank pressure. As the fuel in fuel line 18 and engine compartment cool, however, the fuel line pressure will drop, allowing ball 110 to open fuel line 18 to the fuel tank 12. FIG. 1B illustrates an open position of ball 110 From then onwards, the fuel line may draw or take in some fuel if the temperature decreases (due to thermal contraction of the fuel) or may expel some fuel if the temperature increases (due to thermal expansion of the fuel). The valve remains open to the fuel tank 12 during the remainder of the diurnal period, and if the temperature increases again during long soaks and diurnal cycles. The open end of passage 112 remains under the level of fuel 16 in tank 12 to prevent intake of air into the fuel line, and passage 112 may be directed to ensure this even when the fuel level in tank 12 is low.

Vehicle tests were conducted in VT SHED (variable temperature sealed housing for evaporative determination). The test procedure involved the following steps: 23 min drive (per California Air Resources Board test procedure); 1 hr hot soak in VT SHED; 6 hr cool down at 65° F.; three day diurnal test at 65–105° F.

Figure 2C:
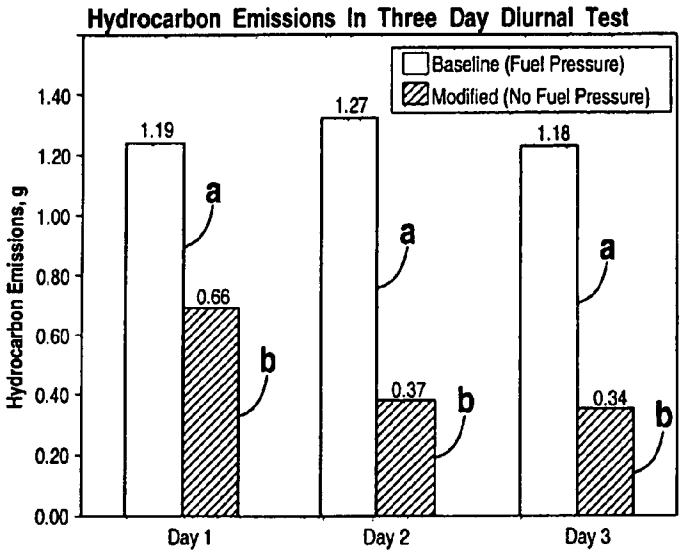
Figure 2A:
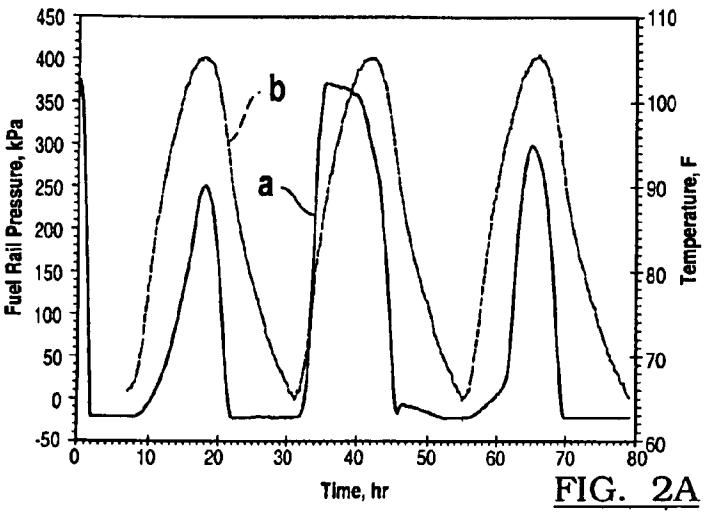

FIG. 2*a* is a graph of fuel rail pressure (line a) measured at the diurnal temperatures of line b for a prior art vehicle configuration without a pressure release valve. The fuel rail pressures caused injector leaks that became evaporative hydrocarbon emissions. The total evaporative hydrocarbon emissions were measured for each day and shown in FIG. 2*c* as bars a. The emissions were 1.19 grams for day 1, 1.27 grams for day 2, and 1.18 grams for day 3 when the pressure in the fuel line and fuel rail was not released during the diurnal period.

Figure 2B:
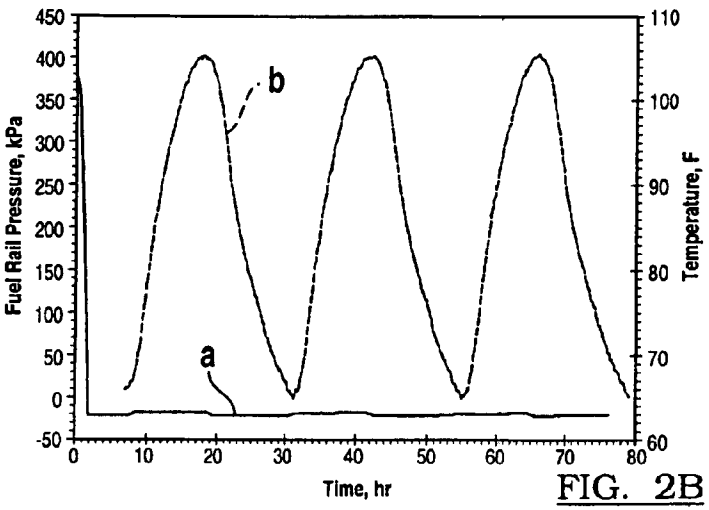

FIG. 2*b* is a graph of fuel rail pressure (line a) measured at the diurnal temperatures of line b for a vehicle configuration according to the present invention. While the initial fuel rail pressure when the engine is shut-down is at about 380 kPa, the same as the pressure in the prior art vehicle configuration, the fuel cools, the pressure release valve opens the fuel line to the fuel tank ambient pressure (0 kPa), and the fuel rail remains unpressurized during the remainder of the diurnal test. Injector leaking due to pressure build up during the diurnals is avoided, and as a result emissions are greatly reduced. The total evaporative hydrocarbon emissions were measured for each day and shown in FIG. 2*c* as bars b. The emissions were 0.66 grams for day 1, 0.37 grams for day 2, and 0.34 grams for day 3 when the pressure in the fuel line and fuel rail was released during the diurnal period according to the invention. The total emissions were reduced from 3.64 grams to 1.37 grams using the method of the invention, nearly a three-fold reduction.

While the fuel in the fuel line and fuel rail is still hot after the engine is first shut down, the fuel has to be under pressure to prevent fuel boiling in the fuel rail. If the fuel boils, it would create gas/vapor bubbles in the fuel tail, which leads to engine hot start problems. Once the fuel cools and the pressure release valve opens the fuel line to ambient fuel tank pressure, however, the pressure release valve remains open until next engine start. During engine start, fuel pump pressure closes the valve and it remains closed until the pressure again drops zero during a diurnal period.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An automotive vehicle comprising:

an engine a fuel tank containing fuel;

a fuel rail having engine fuel injectors extending into an air intake manifold of an air induction system;

a fuel line providing fluid communication between the fuel tank and the fuel rail; and a fuel pump disposed in the fuel tank and configured to supply fuel through the fuel line into the fuel rail during operation of the engine, wherein the fuel pump comprises a pop-open valve that is configured to permit fluid communication of cooled and depressurized fuel from the fuel line to the ambient fuel tank pressure when the engine is not operation, and wherein the valve prevents fluid communication from the fuel line back into the fuel tank when the engine is operating.

2. A method for reducing hydrocarbon emissions from an air induction system of an engine having a fuel line connecting a fuel tank with a fuel rail after the engine is shut down, comprising cooling and depressurizing fuel in the fuel line and fuel rail to prevent boiling; opening the fuel rail to the fuel tank via the fuel line; and preventing increase in fuel pressure in the fuel rail during diurnal temperature increases by opening the fuel line to ambient fuel tank pressure when fuel pressure in the fuel line decreases to the ambient fuel tank pressure.

3. An automotive vehicle comprising an engine, a fuel tank containing fuel, and a fuel pump that supplies fuel under pressure through a fuel line to a fuel rail comprising engine fuel injectors extending into an air intake manifold of an air induction system, the fuel pump comprising a valve that, when the engine is not operating, is configured to permit cooling and depressurizing of fuel in the fuel line and fuel rail to prevent boiling and opens the fuel line to ambient fuel tank pressure when fuel pressure in the fuel line drops to ambient fuel tank pressure and closes when the engine is operating.

4. An automotive vehicle according to claim 3, wherein the fuel pump valve is a pop-open valve.

* * * * *